US006398062B1

(12) United States Patent
Jones

(10) Patent No.: US 6,398,062 B1
(45) Date of Patent: Jun. 4, 2002

(54) DISPOSABLE WASTE FLUID CONTAINMENT DEVICE

(75) Inventor: John K. Jones, Salt Lake City, UT (US)

(73) Assignee: J J Fluid Containment, Inc., Salt Lake City, UT (US)

( * ) Notice: Subject to any disclaimer, the term of this patent is extended or adjusted under 35 U.S.C. 154(b) by 0 days.

(21) Appl. No.: 09/724,617

(22) Filed: Nov. 28, 2000

Related U.S. Application Data

(60) Provisional application No. 60/167,778, filed on Nov. 29, 1999.

(51) Int. Cl.[7] ..... B65D 8/04

(52) U.S. Cl. ..... 220/608; 220/675; 4/516

(58) Field of Search ..... 220/608, 606, 220/605, 604, 635, 572, 571, 914, 670, 671, 675; 4/516, 519, 523, 619, 621

(56) References Cited

U.S. PATENT DOCUMENTS

| | | | | | |
|---|---|---|---|---|---|
| 3,405,858 | A | * | 10/1968 | Collie | 220/608 |
| 3,835,482 | A | * | 9/1974 | Tersch | 220/608 |
| 3,884,383 | A | * | 5/1975 | Burch et al. | 220/608 |
| 4,368,548 | A | | 1/1983 | Glass | 4/451 |
| 5,136,733 | A | | 8/1992 | Church | 4/456 |
| 5,183,179 | A | * | 2/1993 | Morris, Sr. | 220/608 |
| 5,245,713 | A | | 9/1993 | Tickle | 4/516 |
| 5,381,562 | A | | 1/1995 | Holloway et al. | 4/516 |
| 5,487,393 | A | | 1/1996 | Haswell et al. | 128/760 |
| 5,697,921 | A | | 12/1997 | Blair | 604/317 |
| 5,792,125 | A | | 8/1998 | Webb | 604/317 |
| D398,075 | S | | 9/1998 | Book et al. | D28/20 |

* cited by examiner

*Primary Examiner*—Stephen Castellano
(74) *Attorney, Agent, or Firm*—Madson & Metcalf

(57) ABSTRACT

An irrigation basin is disclosed for retaining waste fluids, having a support surface and a trough. The support surface is designed so that a patient can rest a head or extremity, such as a hand or foot, on the surface, while medical personnel flush the head or extremity with fluid or drain wounds found in the body part. The waste fluids are retained by the trough around the support surface. The irrigation basin is also useful for washing the hair of injured or immobile patients, and may further function as an emesis basin. In a preferred embodiment, the support surface slopes to drain fluid into the trough. The support surface can be concave to help cradle the head or other body part. The support surface can also be lower than the outside wall of the trough to minimize fluid splashes outside of the basin. Ribs can be provided in the walls of the basin to increase basin strength and prevent sliding when multiple basins are stacked.

34 Claims, 3 Drawing Sheets

DISPOSABLE WASTE FLUID CONTAINMENT DEVICE

RELATED APPLICATIONS

This application is related to and claims the benefit of United States Provisional Application Serial No. 60/167,778 of John K. Jones, filed Nov. 29, 1999, and entitled "Medical Waste Fluid Containment Device," which is incorporated herein in its entirety by reference.

BACKGROUND

1. The Field of the Invention

This invention relates generally to basins for collecting waste fluid. More particularly, the inventor relates to basins for collecting fluids resulting from irrigating or draining wounds, or from flushing or washing body surfaces. The irrigation basin of the invention includes a trough surrounding a support surface on which a patient can rest an appendage or body part such as a head, foot, or hand.

2. The Background Art

Many medical treatments require flushing a wound or region of the body with water or a wash fluid to clean the wound or wash away a harmful or irritating substance. For example, if harmful chemicals enter a person's eyes, the eyes are flushed with a fluid. Further, some wounds build up quantities of fluid that need to be drained away in order to allow the wound to heal. In some cases, a predetermined minimum quantity of fluid is used in the treatment to flush the body part, such as an eye. Other injuries must be washed to prevent or help treat infection. The resulting waste or irrigation fluid needs to be temporarily contained for later disposal because of possible biological contamination of the fluid. The fluid can be contaminated with a number of pathogens, including AIDS and Hepatitis C, which can be carried by bodily fluids and which can create a hazard for health care workers and others.

One current commonly-used apparatus for retaining this waste fluid is a stainless steel basin. These stainless steel basins are generally formed from a single piece of metal. The steel basins are often "kidney-shaped," with rolled edges. A head, hand, foot or other appendage or body surface may be held over or against the basin to collect waste fluid from a wound or effluent from irrigation of a wound. The curvature of a kidney-shaped basin allows a patient or health care worker to press the affected area against the rim of the basin.

These commonly-used stainless steel basins have the disadvantage that they are not self-supporting, thus requiring a health care worker to steady the patient against or over the basin. This task could be particularly problematic with a patient who is uncooperative, unconscious, impaired, with limited mobility, or in a great deal of pain. Indeed, if the patient cannot help keep the body surface against or above the basin, this task may require more than one health care worker to steady the body surface against or above the basin. Even if only one health care worker is required, the task still leaves the worker with only one free hand.

Another disadvantage of the commonly-used steel basins is that since they require the affected area of a body part to be placed against the rim of the basin or above the basin, splashing of waste fluids is common. Because the surface being washed is elevated above the walls of the basin, the waste fluid falls, easily splashing out of the basin, thereby possibly contaminating the healthcare worker and surrounding areas of the patient's body and clothing.

One positive attribute of the prior art is that when a body surface is held against the rim of the steel basins of the prior art, the surface forms a nearly watertight seal with the curvature of the basin's rolled down or recurved rim. This benefit is often overcome, however, since the rolled-down shape of the rim permits fluid to roll off both sides of the rim, and thus out of the basin as well as into the basin, creating another potential for contamination.

Finally, another disadvantage of the commonly-used steel basins is that these basins are not disposable. They are made of metal, thus also making them heavy and expensive to manufacture and store. If these basins are not properly cleaned and sterilized, they can contaminate others. Stainless steel basins are generally not conveniently stackable as well, and use up more space than a stackable basin would. In stacks, the steel basins are heavy and unmanueverable.

From the foregoing, it will be appreciated that it would be an advancement in the art to provide an irrigation basin which is self-supporting, prevents splashing, and which promotes the movement of fluid into the basin. It could be a further advancement in the art to provide such a basin that is in addition, strong, lightweight, non-metallic, and disposable. It would further be an advancement to provide a basin capable of being sized to receive specific volumes of waste fluid. Such a basin is disclosed herein.

BRIEF SUMMARY OF THE INVENTION

The irrigation basin of the present invention has a support surface surrounded, at least partially, by a trough, thus allowing it to be self-supporting and to support a body part for cleansing or irrigation. The trough may be sized to contain a specified amount of fluid. The support surface allows a patient to rest a body part such as a head, arm, or leg on the basin while that part is flushed, thus freeing the health care worker from the task of steadying the patient over or against the basin. This support surface also reduces the possibility of splashing by stabilizing the body part at and below the level of the basin walls. The basin also decreases spillage over the prior art because the body surface to be washed is placed on the support surface within the basin, not against the rim of the basin. As a result, waste will drain from the support surface into the trough, eliminating contamination from fluid dripping off the rim.

Additionally, the basin of the instant invention is lightweight and disposable, being preferably composed of a single piece of molded plastic. Due to its design, the basin may be constructed of relatively thin sheets of plastic, thus making its production and use more economical, and increasing its functionality by making it more easily disposable and storable.

The basin is designed to have sufficient rigidity and strength to support a body part of an unconscious, uncooperative, or restrained patient due to the plurality of ribs engineered into the outer wall of the basin. The number and size of these ribs is understood by those skilled in the art to be variable within the scope of the instant invention. The strength of the basin makes it ideal for use with patients who are unable to hold the basin themselves by allowing them to simply rest their affected body part on the basin for a given procedure to be performed. This also negates a need for the medical personnel working with the patient to support the basin, thus leaving the health care worker's hands free for their work. This characteristic thus makes the basin useful in irrigating injuries, draining abscesses or other wounds, washing the hair of a patient, or providing an emesis basin for a patient.

Finally, the basin is stackable, being configured to receive another basin to a particular depth. In a preferred embodiment, shelf notches are located in the corners of the basin, such that when two basins are stacked, the shelf notches contact, holding the basins and leaving a gap between them for easy separation. It is clear to those of skill in the art that the placement and number of these notches may be varied without departing from the instant invention. The basin may also have an overhanging rim to help separate stacked basins and to facilitate carrying the basin.

In one embodiment, a U-shaped trough partially surrounds the support surface of the basin. In this basin, the support surface extends to one edge of the basin, allowing the basin to be placed under a patient's head or other appendage without interference from the walls of the basin. The surface may then function easily as a headrest or rest for other body parts.

DESCRIPTION OF THE DRAWINGS

In order to explain the manner in which the advantages and objects of the invention are obtained, a more particular description of the invention briefly described above will be rendered by reference to exemplary embodiments which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
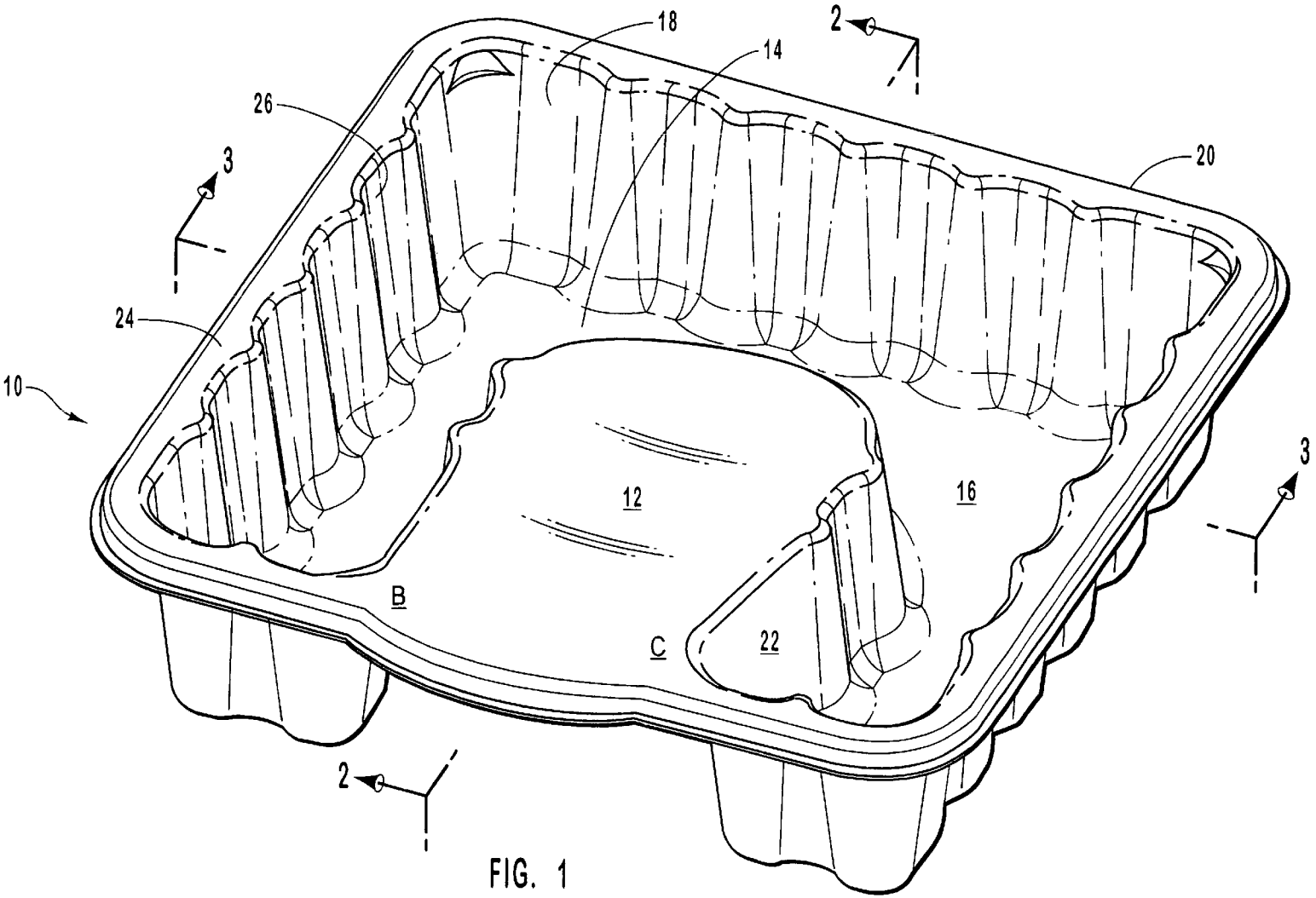
FIG. 1 is a perspective view of a preferred embodiment of the basin of the present invention.
Figure 2:
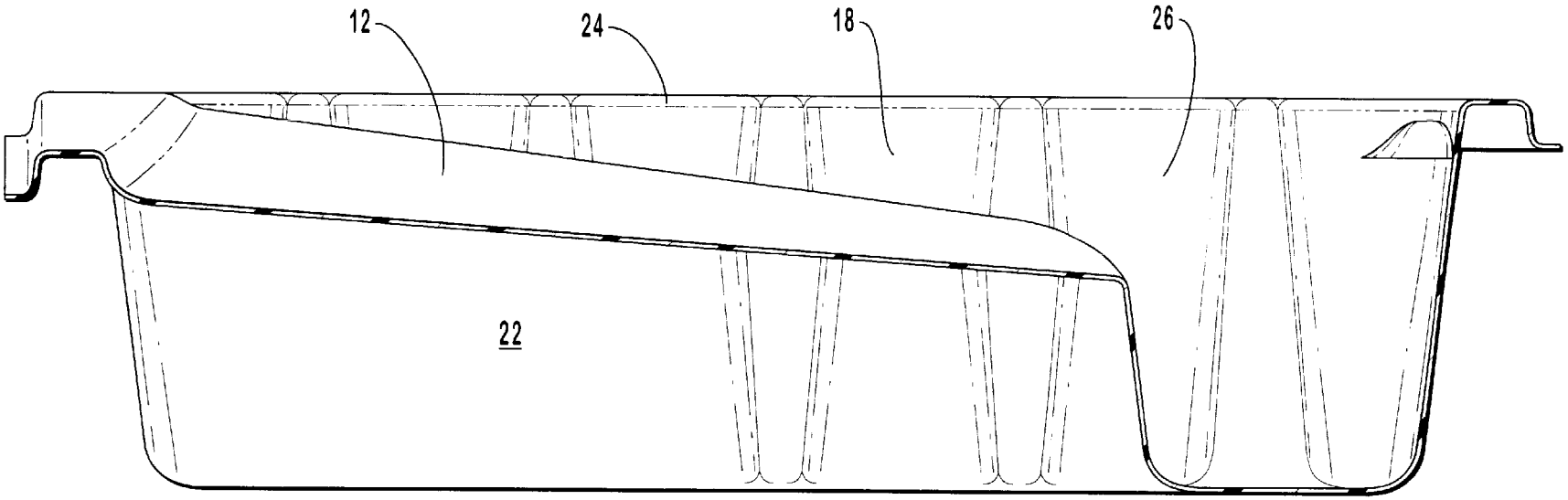
FIG. 2 is a cross-sectional view of the basin of FIG. 1 sectioned at 2—2.
Figure 3:
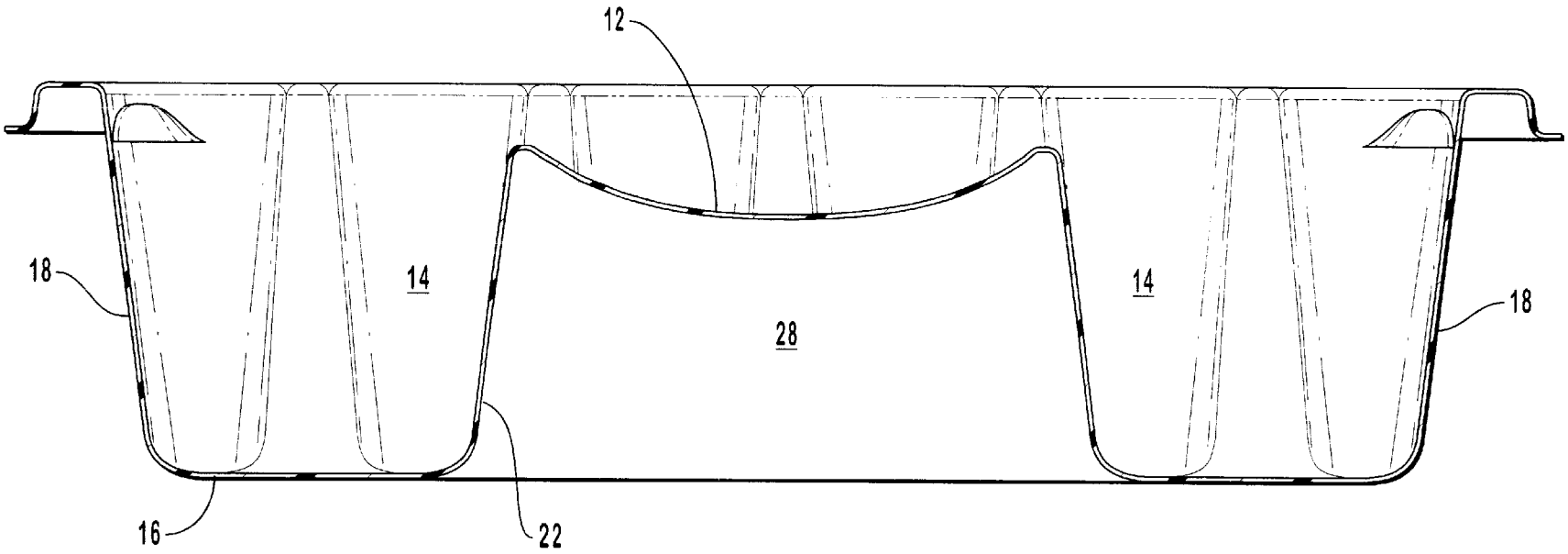
FIG. 3 is a cross-sectional view of the basin of FIG. 1 sectioned at 3—3.

It will be readily understood that the components of the present invention, as generally described and illustrated in the Figures herein, may be arranged and designed in a wide variety of different configurations. Thus, the following more detailed description of embodiments of the present invention, as represented in FIGS. 1 through 3, is not intended to limit the scope of the invention. The scope of the invention is as broad as claimed herein. The illustrations are merely representative of certain presently preferred embodiments of the invention. Those presently preferred embodiments of the invention will be best understood by reference to the drawings, wherein like parts are designated by like numerals throughout.

Those of ordinary skill in the art will, of course, appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

It is understood that the basin of the instant invention, also referred to as an "irrigation basin," is not limited to the function of irrigating wounds. Indeed, one skilled in the art readily understands that the basin may be used for irrigating a wound; draining a wound or abscess; washing the head, hair, or extremities of a patient; simply supporting a head or extremity of a patient, or serving as an emesis basin.

FIG. 1 shows a basin 10 of the instant invention in a perspective view. The basin 10 provides a support surface 12 and a trough 14 designed to retain fluid resulting from irrigating or draining a wound or rinsing a body surface. The support surface 12 is sized so that it can support an appendage or other body part, such as a head, hand or foot.

The trough 14 has a bottom 16 and an outer wall 18. Where the bottom 16 of the trough 14 reaches the outer perimeter of the basin 10, the bottom 16 connects to the trough's outer wall 18. The outer wall 18 forms most of the perimeter 20 of the irrigation basin 10. The outer wall is also continuous with rim 24, which extends horizontally from outer wall 18, and which may act as a grip for the basin. The trough 14 also has an inner wall 22. Inner wall 22 constitutes a base for the support surface 12.

As further shown in FIG. 1, the support surface 12 extends from one side of the perimeter 20 of the basin 10. The support surface 12 joins the outer wall 18 of the trough 14 at points B and C. The trough 14 of this embodiment may have a U-shape which partially surrounds the support surface. In alternate basins of the instant invention, the support surface 12 may be an island, completely unconnected to the outer wall 18 of the trough 14. Alternatively, the support surface 12 may extend across the full length of the basin 10, bisecting or bridging the trough 14. In the illustrated embodiment, support surface 12 has a concave top. In alternative embodiments, the top of the support surface may have different configurations. Persons having ordinary skill in the art will appreciate that there are many possible shapes and configurations for the support surface within the scope of the present invention.

The outer wall 18 and the inner wall 22 of the irrigation basin 10 may have a plurality of ribs 26. The ribs 26 give strength to the outer wall 18 and help prevent sliding between stacked basins. These ribs further act to maximize the strength and stability of the basin of the instant invention while minimizing the thickness and amount of the materials needed to create the basin. The ribs 26 of the illustrated embodiment protrude into the trough 12. Alternatively, the ribs 26 may protrude out of the trough 12. The number and size of the ribs can vary widely. Typically, the numbers of ribs will range from 10 to 50. In the illustrated embodiment, there are twenty-one ribs. The illustrated ribs 26 are about one inch wide and about four inches tall, progressively diminishing in width from the bottom of the basin to the top, and protruding about ¼ inch into the trough 14. However, alternative basins according to the present invention may have any number of ribs of varying size. The ribs may be of any width and of any desired height.

The bottom 16 of the trough 14 is substantially planar in the illustrated preferred embodiment. The planar bottom stabilizes the basin 10 on a flat surface. However, the bottom 16 can be of any shape or texture. For example, the bottom 16 could be rounded, concave, convex, or rippled.

Additionally, the trough 14 can be sized to hold a specified amount of fluid. This amount is determined by measuring the volume of the trough 14 from the bottom 16 to the lowest point of the support surface 12. In the basin shown, the trough 14 is sized to hold about two liters, and may be sized to receive from about 1–4 liters of a fluid.

As mentioned above, the support surface 12 preferably lies in a plane lower than and at an angle to rim 24 of the basin 10. As a result, the height of the basin between points B and C is lower where the support surface 12 meets the basin perimeter 20.

The rim 24 of the irrigation basin can be a variety of shapes. The rim 24 of the illustrated basin is overhanging and squared. This shape helps the user separate stacked basins. It also helps the user grip the basin when it contains fluid. Other basins of the instant invention may have overhanging, rolled down, or recurved rims.

The irrigation basin 10 can be configured in any number of shapes and sizes. For example, the basin 10 may have a square, rectangular, round, oval, kidney or other convenient shape. The shape of the illustrated irrigation basin 10 is generally rectangular with rounded corners to facilitate efficient packing and stacking of the basin. The basin is preferably sized and configured for use with a head or body extremity such as a hand, foot, arm, leg, etc.

FIG. 2 is a cross-sectional view of a preferred embodiment of the irrigation basin cut across section line 2—2 of FIG. 1. FIG. 2 shows that the support surface 12 lies in a plane that is lower than and angled downwardly from the rim 24 of the outer wall 18 of the trough 14. This placement of the support surface 12 minimizes fluid splashes out of the basin 10 because the fluid will drip below the rim 24, where in prior art basins, the fluid dripped from above the rim. This Figure demonstrates the slope of support surface 12. One of skill in the art would readily understand that this slope could be varied within the scope of the instant invention to aid drainage into the trough 14.

FIG. 3 is a cross-sectional view of the irrigation basin, cut across section line 3—3 of FIG. 1. FIG. 3 also shows the concave shape of the support surface 12. The concave shape combined with the slope of support surface 12 helps channel fluid to the end of the support surface 12 interior to the basin, thus protecting the patient from exposure to the fluid. The concave shape also provides a comfortable resting surface and helps keep the patient's head or appendage from sliding sideways off of the support surface 12. This figure further shows a cavity 28 on the underside of the irrigation basin which is configured to allow basins of the instant invention to be stacked one on top of the other.

The basins are preferably manufactured of molded plastic. Although various molding techniques may be used to prepare the basins, thermoforming is a presently preferred molding technique. In thermoforming, plastic sheet material is heated and pressed into a desired shape. A combination of vacuum and external pressure may be used to shape the basin. The plastic starting material is typically provided in large rolls. The optimum thickness is determined by balancing cost (thicker material costs more) and strength (thinner material is weaker). Since the basin is preferably priced sufficiently low to be disposable, the optimum thickness is preferably the minimum thickness capable of providing the desired strength and rigidity.

Thermoplastic materials are preferably used in thermoforming operations. Such plastics include, but are not limited to, poly(ethylene terephthalate) (PET), polyvinyl chloride (PVC), and polystyrene, acrylonitrile-butadiene-styrene (ABS) copolymers, and polypropylene. Various PET materials may be used, including RPET, a recycled PET material; APET, a premium virgin PET material; and PETG, a glycol modified PET which is easier to process and more impact resistant, but less rigid, than virgin PET. RPET material is presently preferred because of its stiffness, rigidity, light weight, ready availability in a recycled form, and cost. When RPET is used to form the basin, the starting sheet material preferably has a thickness greater than about 45 mils (0.045 inches), and more preferably between 45 and 60 mils. Use of these materials in manufacturing the basin of the instant invention allows the materials to be recycled or sanitized.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. An irrigation basin sized and configured to rest on a weight-bearing surface comprising:

a support surface sized and configured to support the weight of a head or extremity of a patient; and a U-shaped trough surrounding the support surface, the trough having a bottom surface configured to rest on a weight-bearing surface when in use; an inner wall having a plurality of ribs; and an outer wall having a plurality of ribs and an overhanging upper edge; wherein the trough is configured to retain a volume of a waste fluid of from about 1 liter to about 4 liters, and wherein the inner wall of the trough is continuous with and transmits weight placed upon the support surface to the bottom surface, and wherein the bottom surface transmits the weight to the weight-bearing surface.

2. The irrigation basin of claim 1, wherein the support surface extends inwardly from the outer wall at a height substantially equal to a height of the overhanging upper edge of the outer wall.

3. The irrigation basin of claim 2, wherein the support surface slopes downwardly away from the overhanging upper edge.

4. The irrigation basin of claim 3, wherein the support surface is disposed above the bottom surface at a height that is closer to the overhanging upper edge than to the bottom surface.

5. The irrigation basin of claim 1, wherein the outer wall of the trough further comprises a plurality of shelf notches to aid in keeping the basin separate when stacked.

6. The irrigation basin of claim 1, wherein the support surface has a concave shape.

7. The irrigation basin of claim 1, wherein the support surface slopes to aid fluid drainage into the trough.

8. The irrigation basin of claim 1, wherein the support surface inclines downwardly as the support surface extends across the basin.

9. The irrigation basin of claim 1, wherein the basin has a generally rectangular shape.

10. The irrigation basin of claim 1, wherein the basin has a generally square shape with rounded corners.

11. The irrigation basin of claim 1, wherein the overhanging edge further comprises a lip to aid carrying the basin.

12. The irrigation basin of claim 1, wherein the basin is manufactured of vacuum-formed plastic.

13. The irrigation basin of claim 1, wherein the bottom surface is substantially planar.

14. The irrigation basin of claim 1, wherein the bottom surface is rounded.

15. An irrigation basin sized and configured to rest on a weight-bearing surface comprising:

a U-shaped trough configured to retain a volume of a waste fluid of from about 1 liter to about 4 liters, the trough having a bottom surface configured to rest on a weight-bearing surface when in use, an inner wall having a plurality of ribs, and an outer wall having a plurality of ribs and an overhanging upper edge; and a support surface sized and configured to support the weight of a head or extremity of a patient, the support surface being continuous with the inner wall of the trough and being configured to transmit weight placed upon the support surface to the bottom surface, wherein the support surface is disposed above the bottom surface at a height that is closer to the overhanging upper edge than to the bottom surface.

16. The irrigation basin of claim 15, wherein the support surface slopes downwardly away from the outer wall.

17. The irrigation basin of claim 16, wherein the support surface extends from the outer wall at a height substantially equal to the height of the basin.

18. The irrigation basin of claim 15, wherein the outer wall of the trough further comprises a plurality of shelf notches to aid in keeping the basin separate when stacked.

19. The irrigation basin of claim 15, wherein the support surface has a concave shape.

20. The irrigation basin of claim 15, wherein the basin has a generally rectangular shape.

21. The irrigation basin of claim 15, wherein the basin has a generally square shape with rounded corners.

22. The irrigation basin of claim 15, wherein the overhanging edge further comprises a lip to aid carrying the basin.

23. The irrigation basin of claim 15, wherein the basin is manufactured of vacuum-formed plastic.

24. The irrigation basin of claim 15, wherein the bottom surface is substantially planar.

25. The irrigation basin of claim 15, wherein the bottom surface is rounded.

26. An irrigation basin sized and configured to rest on a weight-bearing surface comprising:

a U-shaped trough configured to retain from about 1 to about 4 liters of a fluid, the trough surrounding a support surface, wherein the U-shaped trough comprises:

an outer wall comprising a plurality of ribs, and an overhanging edge;

an inner wall comprising a plurality of ribs, wherein the inner wall is continuous with and acts as a base for the support surface; and a bottom surface continuous with the outer and inner walls, wherein the bottom surface transmits weight to the weight-bearing surface; and wherein the support surface is configured to support a head or extremity of a patient, and wherein the support surface extends from the outer wall downward across the basin, beginning at a height substantially equivalent to a height of the overhanging edge, and ending above the bottom surface at a height that is closer to the overhanging upper edge than to the bottom surface.

27. The irrigation basin of claim 26, wherein the outer wall of the trough further comprises a plurality of shelf notches to aid in keeping the basin separate when stacked.

28. The irrigation basin of claim 26, wherein the support surface has a concave shape.

29. The irrigation basin of claim 26, wherein the basin has a generally rectangular shape.

30. The irrigation basin of claim 26, wherein the basin has a generally square shape with rounded corners.

31. The irrigation basin of claim 26, wherein the overhanging edge further comprises a lip to aid carrying the basin.

32. The irrigation basin of claim 26, wherein the basin is manufactured of vacuum-formed plastic.

33. The irrigation basin of claim 26, wherein the bottom surface is substantially planar.

34. The irrigation basin of claim 26, wherein the bottom surface is rounded.

* * * * *